United States Patent [19]

O'Brien et al.

[11] 4,125,382

[45] Nov. 14, 1978

[54] FUELS CONTAINING POLYOXYALKYLENE ETHER DEMULSIFIERS

[75] Inventors: Edward F. O'Brien, Woodhaven; William K. Langdon, Grosse Ile, both of Mich.

[73] Assignee: BASF Wyandotte Corporation, Wyandotte, Mich.

[21] Appl. No.: 786,138

[22] Filed: Apr. 11, 1977

[51] Int. Cl.[2] ..... C10L 1/18; B01D 17/04

[52] U.S. Cl. ..... 44/51; 44/70; 252/331; 252/340

[58] Field of Search ..... 44/51, 70, 77; 252/331, 252/340, 358

[56] References Cited

U.S. PATENT DOCUMENTS

| | | | |
|---|---|---|---|
| 2,550,982 | 5/1951 | Eberz | 44/51 |
| 2,844,451 | 7/1958 | Alpert et al. | 44/70 |
| 2,854,461 | 9/1958 | Groote et al. | 252/331 |
| 2,950,313 | 8/1960 | Kirkpatrick | 252/340 |
| 3,103,101 | 9/1963 | Jaffer | 44/70 |
| 3,579,466 | 5/1971 | Quinlan | 252/340 |

*Primary Examiner*—Allen B. Curtis

*Attorney, Agent, or Firm*—Andrew E. Pierce; Bernhard R. Swick; Robert E. Dunn

[57] ABSTRACT

Fuels containing detergents have improved water tolerance when combined with acetal or ester terminated polyoxyalkylene ether compounds, acetal or carbonate coupled polyoxyalkylene ether compounds or $C_8$–$C_{18}$ epoxide adducts of polyoxyalkylene ether compounds.

20 Claims, No Drawings

FUELS CONTAINING POLYOXYALKYLENE ETHER DEMULSIFIERS

BACKGROUND OF THE INVENTION

1. Field of the Invention

Due to the regulations and requirements for minimizing air pollution from vehicles burning gasoline the vehicle manufacturers have provided engines with means for returning mixtures of various exhaust gases and air to the inlet systems preceding the carburetors. This system unfortunately causes fouling of the fuel and inlet system and tends to increase concentrations of unburned hydrocarbons in the exhaust gases thereby defeating the purposes of the regulation of air pollution. Additionally, the gasoline manufacturers have attempted to counteract the fouling of the engine parts by incorporating compounds with detergent properties in the fuel. These fuels contain not only detergent compounds for the improvement of combustion but a variety of other additives such as those employed for preventing icing, that is, anti-icing agents, antioxidants, metal deactivating agents and other of a similar nature. Because of the various additives which are now deemed necessary in gasoline fuel new problems of water emulsion have arisen during the process of temperature changes which may occur within large storage tanks. Water condensation occurs and causes water to be mixed in with the gasoline fuel. This in turn, due to the additives which are present, creates emulsion problems between the gasoline with the various additives and the water. The emulsions in turn create combustion problems and furthermore can cause freezing of fuel lines for the hapless motorist. In addition, water may reduce the effectiveness of these additives by the emulsion formation.

2. Description of the Prior Art

The prior art is replete with disclosures of motor fuel additives and/or lubricants. Among these are U.S. Pat. Nos. 2,800,400; 2,841,479; 2,844,448; 2,844,449; 2,844,451, and most recently 3,951,614.

Also a number of patents have issued which disclose the use of surfactants for demulsification of either petroleum oil or gasoline or fuel emulsions. Among these are U.S. Pat. Nos. 3,098,827; 3,424,565; and 3,752,675.

U.S. Pat. No. 3,098,827 discloses the use of surface active compounds which are dicarboxylic acid esters of one or more different polyhydroxy compounds at least one of which is an oxyalkylated partial ester of monocarboxylic acids and pentaerythritol or condensation derivatives thereof such as dipentaerythritol and tripentaerythritol.

U.S. Pat. No. 3,424,565 discloses the use of surface active agents which contain phenol formaldehyde condensation products.

U.S. Pat. No. 3,752,675 discloses the use of a demulsifier which is an ethyleneoxy modified methylene bridged polyphenol.

U.S. Pat. No. 3,756,793 discloses the use of polyoxyalkylene glycols as gasoline additives in order to aid in the combustion. None of the prior art discloses specifically the compounds of the instant invention.

SUMMARY OF THE INVENTION

Fuel compositions are provided comprising a major amount of a liquid hydrocarbon fuel boiling in the gasoline range, a minor amount of a surfactant which is composed of an aliphatic hydrocarbon substituted polyamine and a demulsifier in an amount sufficient to inhibit emulsion formation of said fuel mixture with water wherein the demulsifier is selected from a group of polyoxyalkylene ether compounds which have been terminated with acetal or ester groups, or coupled with acetal or carbonate groups. Furthermore, adducts of polyoxyalkylene ether compounds and $C_8$–$C_{18}$ epoxides have also been found to be effective.

DESCRIPTION OF THE PREFERRED EMBODIMENTS

The compositions in accordance with this invention are composed of various polyoxyalkylene ether compounds which are terminated with acetal or ester groups, coupled with acetal or carbonate groups or are adducts of a $C_8$–$C_{18}$ epoxide. The polyoxyalkylene ether compounds are selected from the group consisting of those which are represented by the following formula:

$$X[(C_3H_6O)_n—E—H]_x$$

wherein X is the residue of an organic compound containing therein $x$ active hydrogen atoms, $n$ is an integer, $x$ is an integer greater than 1, the values of $n$ and $x$ are such that the molecular weight of the compound, exclusive of E, is at least 900, E is a polyoxyalkylene chain wherein the oxygen/carbon atom ratio is at least 0.5, and E constitutes 20–90 percent by weight of the compound. These compounds are more particularly defined in U.S. Pat. No. 2,674,619 which disclosure is incorporated herein by reference.

Another polyoxyalkylene ether compound is represented by the formula:

$$Y(PK)_yH_y$$

wherein Y is the residue of an organic compound having $y$ reactive hydrogens and up to 6 carbon atoms, P is a hydrophobic polyoxyalkylene chain having an oxygen/carbon atom ratio of not more than 0.40, the molecular weight of P and the value of $y$ being such that the molecule excluding K has a molecular weight of at least about 400 to 900 and up to about 25,000 and K is a hydrophilic polyoxyalkylene chain which (1) contains oxyethylene groups and at least 5 percent by weight of higher molecular weight oxyalkylene groups having at least 3 carbon atoms in their structure, and (2) has an average oxygen/carbon atom ratio of greater than 0.40, K being present in the composition in an amount sufficient to constitute from about 10 percent to about 90 percent by weight of the total composition. These compounds are more particularly described in U.S. Pat. No. 3,101,374 which disclosure is incorporated herein by reference.

Still another class of polyoxyalkylene ether compounds are those described as $$R—O(A)_mH$$

wherein R is a straight chain alkyl group having from 8 to 20 carbon atoms, A is a mixture of oxypropylene and oxyethylene groups, the oxypropylene to oxyethylene ratio of said total weight being from 0.5:1 to 2.75:1, and $m$ is an integer such that the oxyalkylene groups constitute from 55 to 80 percent by weight of the compound. These compounds are prepared either by a random addition of oxyalkylene groups or sequential addition thereof. These compounds are more particularly defined in U.S. Pat. Nos. 3,340,309, and 3,504,041 which disclosures are incorporated herein by reference.

The most preferred class of demulsifiers are the acetal and carbonate coupled alkoxylates of linear aliphatic alcohols. These compounds can be generally described as $$RO(A)_m-\overset{\overset{\displaystyle O}{\|}}{C}-(A)_mOR$$

for the carbonate coupled and $$RO(A)_m-\underset{\underset{\displaystyle H}{|}}{\overset{\overset{\displaystyle CH_3}{|}}{C}}-(A)_mOR$$

for the acetal coupled wherein R, A, and $m$ are as defined above.

The carbonate coupled compounds may be prepared by reacting 2 moles of the polyoxyalkylene ether compound with 1 mole of a dialkyl carbonate such as diethyl carbonate or diisopropyl carbonate in the presence of an alkaline catalyst such as potassium carbonate at a concentration from about 0.01 to 1 weight percent based on the total weight of the reactants. Upon raising the temperature to about 200° C., an alkanol and excess dialkyl carbonate are distilled off resulting in the coupling reaction. The product is then filtered to remove the residual catalyst and the product is then evaluated as a demulsifier.

The acetal coupled compounds may be prepared by reacting the polyoxyalkylene compound with vinyl ethers containing from 3 to 6 carbon atoms in the presence of a catalyst such as methane sulfonic acid at a concentration level of 0.01 to 1 weight percent based on the total weight of the reactants. Upon heating to a temperature of about 100° C. at reduced pressures of less than 10 mm a dialkyl acetal can be stripped off resulting in the acetal coupled compound.

Other preferred demulsifiers are those acetal or ester terminated compounds which correspond to the formula $$Y[(C_3H_6O)_n-E-]_x-Z-_x$$

wherein Y, E, and $x$ are as defined above and Z is selected from the group consisting of acetal groups containing from 3 to 6 carbon atoms or alkyl carboxylic acid ester groups containing from 8 to 20 carbon atoms.

The acetal terminated compounds may be prepared by reacting the selected compound with a slight molar excess of a vinyl ether containing from 3 to 6 carbon atoms, such as ethyl vinyl ether, isopropyl vinyl ether or isobutyl vinyl ether, in the presence of an acidic catalyst such as methane sulfonic acid at a concentration of from 0.01 to 1 percent based on the weight of the polyoxyalkylene ether compound. The reaction is allowed to proceed at temperature ranges from 25° to about 80° C. After a reaction time of from 1 to 3 hours the product is then stripped of volatiles and evaluated as a demulsifier.

The ester terminated compounds may be prepared by reacting the selected compound with an equimolar amount of an alkyl carboxylic acid containing from 8 to 20 carbon atoms in the presence of an esterification catalyst such as stannous octoate or p-toluene sulfonic acid at concentrations ranging from 100 to 1000 ppm. Ester exchange procedures may also be employed to prepare these esters. The water of esterification may be removed by an azeotropic distillation employing a solvent such as toluene.

Still other preferred demulsifiers are the acetal terminated alkoxylates of linear aliphatic alcohols. These compounds are represented structurally as $$RO(A)_m-\underset{\underset{\displaystyle H}{|}}{\overset{\overset{\displaystyle CH_3}{|}}{C}}-O-C_pH_{2p+1}$$

wherein R, A, and $m$ are as defined above and $p$ is an integer from 1 to 4.

Another preferred class of demulsifiers are the acetal and ester terminated polyoxyalkylene compounds having heteric polyoxyalkylene chains and which are represented structurally as $$Y(PE)_yH_rZ_z$$

wherein Y, P, E, Z and $y$ are as defined above, $r$ is an integer from 0 to $y$-1 and $z$ is an integer from 1 to $y$. The starting polyoxyalkylene ether compounds are more particularly described in U.S. Pat. No. 3,101,374. The acetal and ester terminated compounds may be prepared as described above.

Still other demulsifying compounds contemplated in accordance with this invention are $C_8$–$C_{18}$ epoxide adducts of the various polyoxyalkylene ether compounds discussed heretofor. These compounds may be described by the following formulas:

$$X[(C_3H_6O)_n-E]_yH_{x-1}Q$$

wherein X, E, $n$ and $x$ are as defined above, Q is $C_aH_{2a}OH$, and $a$ is an integer from 8 to 18, $$Y(PK)_yH_{y-1}Q$$

wherein Y, P, K, Q and $y$ are as defined above, and $$RO(A)_mQ$$

wherein R, A, Q and $m$ are as defined above.

These adducts may be prepared by reacting the desired polyoxyalkylene ether compound with a $C_8$–$C_{18}$ epoxide in the presence of an alkaline catalyst such as potassium hydroxide at a concentration range from about 0.1 to 0.5 weight percent based on the total weight of the reactants. The product is then stripped of volatiles and evaluated as a demulsifier.

The demulsifiers contemplated in this invention may be employed in the fuel composition from about 1 to about 50 parts per million, perferably from 5 to 30 parts per million. The general procedure employed for testing the effect of demulsifiers is as follows. Gasoline containing a detergent additive and a demulsifier is mixed with water in a 4:1 gasoline:water ratio and put into emulsion viewer tubes. These tubes are then mechanically rotated for two minutes at 30 cycles per minute. The tubes are then placed in an emulsion viewer. The clarity of the gasoline and the interface characteristics are determined after a period of designated time. In evaluating the gasoline phase the clarity is determined to be either sparkling clear (Cl), slightly hazy (SH), or hazy (H). At the gasoline/water interface the determinations were made in the following manner, either perfectly sharp (A) or sharp with less than 50 percent film on the interface (B), sharp with more than 50 percent film on the interface (C), or sharp with a complete film (D).

In determining whether a particular compound is an effective demulsifier the standard applied is one that gives a rating of no greater than slightly hazy (SH) in the gasoline phase and not less than a C rating for the gasoline/water interface. This indicates that the demulsifier has effectively excluded the water from the gasoline phase and is itself sufficiently soluble in the water phase as not to create a film at the gasoline/water interface. This phenomena requires the proper balance of hydrophile and hydrophobe. The demulsifier must be sufficiently hydrophobic in nature to solubilize in the gasoline to break the emulsion which exists and yet it must also be sufficiently hydrophilic to prefer the aqueous phase which separates from the gasoline phase. It is further desirable from an economic point of view that the demulsifier be effective at concentrations of less than 100 parts per million.

Liquid hydrocarbon fuel emulsions with water may also be demulsified by treatment of the emulsion with the polyoxyalkylene products described above. The products are added to the emulsion, agitation is applied and sufficient time is allowed for settling of the hydrocarbon fuel and the water into their respective phases.

The following examples are provided to further illustrate the invention. In these examples the composition of the demulsifiers as designated by the letters A, B, etc., are as follows.

Composition A is a propylene glycol ethylene oxide propylene oxide adduct having a molecular weight of about 2200 and containing about 28 percent by weight ethylene oxide.

Composition B is an ethyl acetal terminated propylene glycol ethylene oxide propylene oxide adduct having a molecular weight of about 2200 containing about 28 percent by weight ethylene oxide.

Composition C is a propylene glycol propylene oxide adduct having a molecular weight of about 1700.

Composition D is an ethylene glycol propylene oxide ethylene oxide adduct having a molecular weight of about 2800 containing about 13 weight percent ethylene oxide.

Composition E is an ethyl acetal terminated adduct of a propylene oxide ethylene oxide adduct of a $C_{12}$–$C_{18}$ alcohol blend having a molecular weight of about 1000 and containing about 42 percent by weight ethylene oxide.

Composition F is an ethyl acetal terminated propylene oxide ethylene oxide adduct of a $C_{12}$–$C_{18}$ alcohol blend having a molecular weight of about 1100 and containing about 60 percent by weight ethylene oxide.

Composition G is an ethyl acetal terminated polyoxypropylene glycol having a molecular weight of about 3000.

Composition H is a carbonate coupled product of 2 moles of a propylene oxide-ethylene oxide adduct of a $C_{12}$–$C_{18}$ alcohol blend having a molecular weight of about 1000 and containing about 42 percent by weight ethylene oxide.

Composition I is a 1:1 mole adduct of a $C_8$–$C_{18}$ epoxide with a sorbitol propylene oxide adduct, the sorbitol adduct having a molecular weight of about 500.

Composition J is an isobutyl acetal terminated propylene glycol ethylene oxide propylene oxide adduct having a molecular weight of about 2200 containing about 28 percent by weight ethylene oxide.

Composition K is the dioleate ester of a propylene glycol propylene oxide ethylene oxide adduct having a molecular weight of about 8000 and containing about 80 percent by weight ethylene oxide.

Composition L is an ethyl acetal terminated propylene oxide ethylene oxide adduct of a $C_{12}$–$C_{18}$ alcohol blend having a molecular weight of about 900 containing about 24 percent ethylene oxide.

Composition M is an acetal coupled product of 2 moles of a propylene oxide ethylene oxide adduct of a $C_{12}$–$C_{18}$ alcohol blend having a molecular weight of 1000 and containing about 42 percent by weight ethylene oxide.

Composition N is a carbonate coupled product of 2 moles of a propylene oxide ethylene oxide adduct of a $C_{12}$–$C_{18}$ alcohol blend having a molecular weight of 1000 and containing about 42 percent by weight ethylene oxide.

Composition O is a carbonate coupled product of 2 moles of a propylene oxide ethylene oxide adduct of a $C_{12}$–$C_{18}$ alcohol having a molecular weight of about 1000 and containing about 60 percent by weight ethylene oxide.

Composition B was prepared by adding to a 2-liter reaction flask 1284 grams (1 hydroxyl equivalent) of the propylene glycol-ethylene oxide propylene oxide adduct 0.2 grams of methane sulfonic acid catalyst. 80 grams (1.2 moles) of ethyl vinyl ether was added over a period of 30 minutes at temperatures between 30° and 37° C. The mixture was reacted for 1.0 hour at a temperature range of 31° to 37° C. When analysis by infra-red indicated that all hydroxyl groups had reacted, six grams of a tertiary amine was added and the product was stripped of volatiles at 100° C. and 2 mm pressure.

Compositions E, F, G, and L were prepared in a manner similar to that employed for Composition B. Composition J was prepared employing isobutyl vinyl ether in a manner similar to that employed for Composition B.

Composition M was prepared by adding to a 2-liter reaction flask, 981 grams (1 hydroxyl equivalent) of the $C_{12}$-$C_{18}$ alcohol propylene oxide ethylene oxide adduct with 1.96 grams of methane sulfonic acid catalyst. 79.3 grams of ethyl vinyl ether was added over a period of 30 minutes at a temperature range of 35°–31° C. The reaction was allowed to continue for another 30 minutes. The mixture was then heated to 102° C., at 2 mm of pressure during which time 40.2 grams of volatiles, mainly diethyl acetal, were collected. The product was then stabilized by the addition of 5.4 grams of a tertiary amine.

Composition N was prepared by adding to a 1-liter reaction flask, 738 grams (0.75 mole) of the $C_{12}$–$C_{18}$ alcohol, propylene oxide, ethylene oxide adduct, 133 grams of diethyl carbonate, 1.5 grams of potassium carbonate, and 2.0 grams of a 20 percent solution of potassium hydroxide in methanol. The mixture was heated at reflux temperatures employing a distillation column with a take-off head. A total of 37.8 grams of ethanol was collected during a 10 hour period. The product was then stripped at temperatures up to 125° C. at 6 mm pressure to remove additional ethanol and excess diethyl carbonate. The cloudy crude product was clarified by filtering through a High Flow Super Cell filter.

Composition O was prepared in a manner similar to that employed for Composition N.

Composition K was prepared by adding to a 2-liter reaction flask equipped with a distillation column and take-off receiver, 775 grams of the propylene glycol, propylene oxide, ethylene oxide adduct, 5.3 grams of methane sulfonic acid and 44 grams of oleic acid. The reaction mixture was heated to a temperature range of 154°–161° C. at 3 mm pressure for 3 hours removing the volatiles. 1.0 gram sodium carbonate was added and the product was restripped at 90° C., 4 mm pressure for 1 hour.

Composition I was prepared by adding to a one gallon autoclave, 1001 grams of sorbitol and 3.5 grams of tertiary butyl amine. After heating to 135° C., 1972 grams of propylene oxide was added over a 9 hour period with 3.5 grams additional tertiary butyl amine. The product was then stripped of volatiles at 100° C. To a 1-liter reaction flask was added 424 grams of the above product and 2.48 grams of 90 percent potassium hydroxide. The mixture was heated to 125° C. and then stripped at 133° C., 2 mm pressure to remove volatiles. 300 grams of $C_{15}$–$C_{18}$ epoxide was added over a 95 minute period. The reaction was allowed to proceed for an additional hour at temperatures from 140°–149° C. The resulting product was then stripped of volatiles at 151° C. and 2 mm pressure.

Compositions A, C, D, H and J were prepared by normal oxyalkylation procedures as described in the patents cited supra.

EXAMPLE 1–23

In Example 1, 32 mls of gasoline and 8 mls of water were placed into an emulsion viewer tube and sealed with a stopper. The tube was mechanically rotated for 2 minutes at 30 cycles per minute. The tube was then placed into an emulsion viewer and the clarity of the gasoline and the interface characteristics were checked at the end of two hours.

In Example 2 the gasoline contained 500 ppm of an aliphatic hydrocarbon substituted ethylene polyamine as a detergent additive. The gasoline was mixed with water in a manner similar to Example 1. The results are shown in the Table below.

Examples 3–23 employed gasoline similar to that of Example 2. The various demulsifiers alone and in combination with other components as designated below were added to the gasoline and the demulsification efficacy was determined by following the procedure of Example 1.

Table

Performance of Demulsifiers in Fresh Gasoline Samples

| | Demulsifiers System | | | | Demulsifier Performance at 2 hours | |
|---|---|---|---|---|---|---|
| Ex. | Composition | Conc. (ppm) | Composition | Conc. (ppm) | Gasoline | Interface |
| 1 | — | — | — | — | Cl | A |
| 2 | — | — | — | — | H | 9 |
| 3 | A | 25 | — | — | SH | D |
| 4 | B | 25 | — | — | Cl | C |
| 5 | B | 25 | C | 2 | Cl | A-B |
| 6 | B | 25 | D | 4 | Cl | A |
| 7 | E | 25 | — | — | Cl | A-B |
| 8 | B | 25 | E | 2 | Cl | A |
| 9 | F | 25 | — | — | Cl | A-B |
| 10 | B | 25 | F | 2 | Cl | B |
| 11 | G | 25 | — | — | SH | B |
| 12 | B | 25 | G | 2 | Cl | A |
| 13 | B | 25 | H | 2 | Cl | A |
| 14 | I | 6 | — | — | Cl | A-B |
| 15 | B | 14 | I | 12 | Cl | A-B |
| 16 | J | 25 | — | — | Cl | A |
| 17 | J | 25 | C | 2 | Cl | A |

Table-continued

Performance of Demulsifiers in Fresh Gasoline Samples

| | Demulsifiers System | | | | Demulsifier Performance at 2 hours | |
|---|---|---|---|---|---|---|
| Ex. | Composition | Conc. (ppm) | Composition | Conc. (ppm) | Gasoline | Interface |
| 18 | K | 25 | — | — | Cl | A |
| 19 | L | 25 | — | — | Cl | B |
| 20 | M | 25 | — | — | Cl | A-B |
| 21 | N | 25 | — | — | Cl | A-B |
| 22 | O | 6 | — | — | Cl | A |
| 23 | O | 4 | I | 2 | Cl | A-B |

Gasoline Phase
Cl = sparkling clear
SH = slightly hazy
H = hazy
Gasoline/Water Interface
A = perfectly sharp
B = sharp with <50% film
C = sharp with >50% film
D = sharp with complete film
Number grade = interface thickness in divisions on emulsions viewer The results in the above Table indicate that gasoline alone, Example 1, will not emulsify with water. Example 2 illustrates the emulsion created by the presence of a detergent in the gasoline. The numeral 9 indicates the thickness of the interface emulsion from the divisions on the emulsion viewer. In Example 3, it can be seen that Component A is not an effective demulsifier as evidenced by the slightly hazy appearance of the gasoline phase and a D rating for the interface. The other components in various combinations and concentrations do effectively demulsify the gasoline/water emulsion.

The embodiments of the invention in which an exclusive property or privilege is claimed are defined as follows:

1. A fuel composition comprising a major amount of a liquid hydrocarbon fuel boiling in the gasoline range said full containing a detergent additive and a demulsifier, in an amount sufficient to inhibit emulsion formation of said fuel with water, said demulsifier selected from the group of polyoxyalkylene ether compounds derived from a mixture of ethylene oxide and propylene oxide and terminated with acetal or ester groups, said ester derived from the reaction of said ether with an alkyl carboxylic acid having from 8 to 20 carbon atoms and wherein said polyoxyalkylene ether compounds are selected from the group represented by the formulas:

$$X\,[(C_3H_6O)_n\text{—}E\text{—}H]_x \qquad \text{(a)}$$

wherein X is the residue of an organic compound containing therein $x$ active hydrogen atoms, $n$ is an integer, $x$ is an integer greater than 1, the values of $n$ and $x$ are such that the molecular weight of the compound, exclusive of E, is at least 900, E is a polyoxyalkylene chain wherein the oxygen/carbon atom ratio is at least 0.5, and E constitutes 20–90 percent by weight of the compound, $$Y(PK)_yH_y \qquad \text{(b)}$$

wherein Y is the residue of an organic compound having $y$ reactive hydrogens and up to 6 carbon atoms, P is a hydrophobic polyoxyalkylene chain having an oxygen/carbon atom ratio of not more than 0.40, the molecular weight of P and the value of $y$ being such that the molecule excluding K has a molecular weight of at least about 400 to 900 and up to about 25,000 and K is a hydrophilic polyoxyalkylene chain which (1) contains oxyethylene groups and at least 5 percent by weight of higher molecular weight oxyalkylene groups having at least 3 carbon atoms in their structure, and (2) has an average oxygen/carbon atom ratio of greater than 0.40, K being present in the composition in an amount sufficient to constitute from about 10 percent to about 90 percent by weight of the total composition, and $$RO(A)_mH \quad (c)$$

wherein R is a straight chain alkyl group having from 8 to 20 carbon atoms, A is a mixture of oxypropylene and oxyethylene groups, the oxypropylene to oxyethylene ratio of said total weight being from 0.5:1 to 2.75:1, and *m* is an integer such that the oxyalkylene groups constitute from 55 to 80 percent by weight of the compound.

2. The composition of claim 1 wherein the concentration of demulsifier is from about 1 to about 50 parts per million.

3. The composition of claim 1 wherein the concentration of demulsifier is from about 5 to about 30 parts per million.

4. A fuel composition comprising a major amount of a liquid hydrocarbon fuel boiling in the gasoline range and a demulsifier, in an amount sufficient to inhibit emulsion formation of said fuel with water, said demulsifier selected from the group of polyoxyalkylene ether compounds coupled with an acetal or a carbonate group wherein said polyoxyalkylene ether compounds are represented by the formula $$RO(A)_mH$$

wherein R is a straight chain alkyl group having from 8 to 20 carbon atoms, A is a mixture of oxypropylene and oxyethylene groups, the oxypropylene to oxyethylene ratio of said total weight being from 0.5:1 to 2.75:1, and *m* is an integer such that the oxyalkylene groups constitute from 55 to 80 percent by weight of the compound.

5. The composition of claim 4 wherein the concentration of demulsifier is from about 1 to about 50 parts per million.

6. The composition of claim 4 wherein the concentration of demulsifier is from about 5 to about 30 parts per million.

7. A fuel composition comprising a major amount of a liquid hydrocarbon fuel boiling in the gasoline range and a demulsifier in an amount sufficient to inhibit emulsion formation of said fuel with water, said demulsifier being a 1:1 mole adduct of a $C_8$–$C_{18}$ epoxide with a polyoxyalkylene ether compound.

8. The composition of claim 7 wherein said polyoxyalkylene ether compounds are selected from the group represented by the formulas:

$$X[(C_3H_6O)_n—E—H]_x \quad (a)$$

wherein X is the residue of an organic compound containing therein *x* active hydrogen atoms, *n* is an integer, *x* is an integer greater than 1, the values of *n* and *x* are such that the molecular weight of the compound, exclusive of E is at least 900, E is a polyoxyalkylene chain wherein the oxygen/carbon atom ratio is at least 0.5, and E constitutes 20–90 percent by weight of the compound, $$Y(PK)_yH_y \quad (b)$$

wherein Y is the residue of an organic compound having y reactive hydrogens and up to 6 carbon atoms, P is a hydrophobic polyoxyalkylene chain having an oxygen/carbon atom ratio of not more than 0.40, the molecular weight of P and the value of *y* being such that the molecule excluding K has a molecular weight of at least about 400 to 900 and up to about 25,000 and K is a hydrophilic polyoxyalkylene chain which (1) contains oxyethylene groups and at least 5 percent by weight of higher molecular weight oxyalkylene groups having at least 3 carbon atoms in their structure, and (2) has an average oxygen/carbon atom ratio of greater than 0.40, K being present in the composition in an amount sufficient to constitute from about 10 percent to about 90 percent by weight of the total composition, and $$RO(A)_mH \quad (c)$$

wherein R is a straight chain alkyl group having from 8 to 20 carbon atoms, A is a mixture of oxypropylene and oxyethylene groups, the oxypropylene to oxyethylene ratio of said total weight being from 0.5:1 to 2.75:1, and *m* is an integer such that the oxyalkylene groups constitute from 55 to 80 percent by weight of the compound.

9. The composition of claim 7 wherein the concentration of demulsifier is from about 1 to about 50 parts per million.

10. The composition of claim 7 wherein the concentration of demulsifier is about 6 parts per million.

11. A process for demulsifying an emulsion consisting of a liquid hydrocarbon fuel boiling in the gasoline range said fuel containing a detergent additive and water wherein said emulsion is treated with an effective amount of polyoxyalkylene ether compounds derived from a mixture of ethylene oxide and propylene oxide and terminated with acetal or ester groups, said ester derived from the reaction of said ether with an alkyl carboxylic acid having from 8 to 20 carbon atoms and wherein said polyoxyalkylene ether compounds are selected from the group represented by the formulas:

$$X[(C_3H_6O)_n—E—H]_x \quad (a)$$

wherein X is the residue of an organic compound containing therein *x* active hydrogen atoms, *n* is an integer, *x* is an integer greater than 1, the values of *n* and *x* are such that the molecular weight of the compound, exclusive of E, is at least 900, E is a polyoxyalkylene chain wherein the oxygen/carbon atom ratio is at least 0.5, and E constitutes 20–90 percent by weight of the compound, $$Y(PK)_yH_y$$

wherein Y is the residue of an organic compound having y reactive hydrogens and up to 6 carbon atoms, P is a hydrophobic polyoxyalkylene chain having an oxygen/carbon atom ratio of not more than 0.40, the molecular weight of P and the value of *y* being such that the molecule excluding K has a molecular weight of at least about 400 to 900 and up to about 25,000 and K is a hydrophilic polyoxyalkylene chain which (1) contains oxyethylene groups and at least 5 percent by weight of higher molecular weight oxyalkylene groups having at least 3 carbon atoms in their structure, and (2) has an average oxygen/carbon atom ratio of greater than 0.40, K being present in the composition in an amount sufficient to constitute from about 10 percent to about 90 percent by weight of the total composition, and $RO(A)_mH$ wherein R is a straight chain alkyl group having from 8 to 20 carbon atoms, A is a mixture of oxypropylene and oxyethylene groups, the oxypropylene to oxyethylene ratio of said total weight being from 0.5:1 to 2.75:1, and *m* is an integer such that the oxyalkylene groups constitute from 55 to 80 percent by weight of the compound.

12. The process of claim 11 wherein the concentration of polyoxyalkylene ether compound is from about 1 to about 50 parts per million.

13. The process of claim 11 wherein the concentration of polyoxyalkylene ether compound is from about 5 to about 30 parts per million.

14. The process for demulsifying an emulsion consisting of a liquid hydrocarbon fuel boiling in the gasoline range and water wherein said emulsion is treated with an effective amount of polyoxyalkylene compounds coupled with an acetal or a carbonate group wherein said polyoxyalkylene ether compounds are selected from the group represented by the formulas:

$$X[(C_3H_6O)_n—E—H]_x \quad (a)$$

wherein X is the residue of an organic compound containing therein *x* active hydrogen atoms, *n* is an integer, *x* is an integer greater than 1, the values of *n* and *x* are such that the molecular weight of the compound, exclusive of E, is at least 900, E is a polyoxyalkylene chain wherein the oxygen/carbon atom ratio is at least 0.5, and E constitutes 20–90 percent by weight of the compound, $$Y(PK)_yH_y \quad (b)$$

wherein *Y* is the residue of an organic compound having *y* reactive hydrogens and up to 6 carbon atoms, P is a hydrophobic polyoxyalkylene chain having an oxygen/carbon atom ratio of not more than 0.4, the molecular weight of P and the value of *y* being such that the molecule excluding K has a molecular weight of at least about 400 to 900 and up to about 25,000 and K is a hydrophilic polyoxyalkylene chain which (1) contains oxyethylene groups and at least 5 percent by weight of higher molecular weight oxyalkylene groups having at least 3 carbon atoms in their structure, and (2) has an average oxygen/carbon atom ratio of greater than 0.40, K being present in the composition in an amount sufficient to constitute from about 10 percent to about 90 percent by weight of the total composition, and $$RO(A)_mH \quad (c)$$

wherein R is a straight chain alkyl group having from 8 to 20 carbon atoms, A is a mixture of oxypropylene and oxyethylene groups, the oxypropylene to oxyethylene ratio of said total weight being from 0.5:1 to 2,75:1, and *m* is an integer such that the oxyalkylene groups constitute from 55 to 80 percent by weight of the compound.

15. The process of claim 14 wherein the concentration of polyoxyalkylene ether compound is from about 1 to about 50 parts per million.

16. The process of claim 14 wherein the concentration of polyoxyalkylene ether compound is from about 5 to about 30 parts per million.

17. A process for demulsifying an emulsion consisting of a liquid hydrocarbon fuel boiling in the gasoline range and water wherein said emulsion is treated with an effective amount of a 1:1 mole adduct of a $C_8$–$C_{18}$ epoxide with a polyoxyalkylene ether compound.

18. The process of claim 17 wherein said polyoxyalkylene ether compounds are selected from the group represented by the formulas:

$$X[(C_3H_6O)_n—E—H]_X \quad (a)$$

wherein X is the residue of an organic compound containing therein *x* active hydrogen atoms, *n* is an integer, *x* is an integer greater than 1, the values of *n* and *x* are such that the molecular weight of the compound, exclusive of E, is at least 900, E is a polyoxyalkylene chain wherein the oxygen/carbon atom ratio is at least 0.5, and E constitutes 20–90 percent by weight of the compound, $$Y(PK)_yH_y \quad (b)$$

wherein Y is the residue of an organic compound having *y* reactive hydrogens and up to 6 carbon atoms, P is a hydrophobic polyoxyalkylene chain having an oxygen/carbon atom ratio of not more than 0.40, the molecular weight of P and the value of *y* being such that the molecule excluding K has a molecular weight of at least about 400 to 900 and up to about 25,000 and K is a hydrophilic polyoxyalkylene chain which (1) contains oxyethylene groups and at least 5 percent by weight of higher molecular weight oxyalkylene groups having at least 3 carbon atoms in their structure, and (2) has an average oxygen/carbon atom ratio of greater than 0.40, K being present in the composition in an amount sufficient to constitute from about 10 percent to about 90 percent by weight of the total composition, and $RO(A)_mH$ wherein R is a straight chain alkyl group having from 8 to 20 carbon atoms, A is a mixture of oxypropylene and oxyethylene groups, the oxypropylene to oxyethylene ratio of said total weight being from 0.5:1 to 2.75:1, and *m* is an integer such that the oxyalkylene groups constitute from 55 to 80 percent by weight of the compound.

19. The process of claim 17 wherein the amount of polyoxyalkylene ether compound $C_8$–$C_{18}$ epoxide adduct is from about 1 to about 50 parts per million.

20. The process of claim 17 wherein the amount of polyoxyalkylene ether compound $C_8$–$C_{18}$ epoxide adduct is from about 5 to about 30 parts per million.

* * * * *